US005890844A

United States Patent [19]

Schellhorn

[11] Patent Number: 5,890,844

[45] Date of Patent: Apr. 6, 1999

[54] SINGLE ENGINE SOIL PROCESSING SYSTEM

[76] Inventor: Verne L. Schellhorn, 32987 Highway One South, Gualala, Calif. 95445

[21] Appl. No.: 947,083

[22] Filed: Oct. 8, 1997

[51] Int. Cl.[6] ..... E02D 3/12

[52] U.S. Cl. ..... 405/267; 405/232; 405/263; 405/269

[58] Field of Search ..... 405/231, 232, 405/267, 240, 241, 242, 269, 263

[56] References Cited

U.S. PATENT DOCUMENTS 4,958,962 9/1990 Schellhorn ..... 405/267
5,160,220 11/1992 Yoshida et al. ..... 405/240 X
5,396,964 3/1995 Shellhorn et al. ..... 405/232 X
5,542,786 8/1996 Blum ..... 405/241 X

*Primary Examiner*—Dennis L. Taylor
*Attorney, Agent, or Firm*—Bruce H. Johnsonbaugh

[57] ABSTRACT

An apparatus and method for processing soil in a subterranean situs is provided wherein a pressurized slurry is introduced through a soil processing tool and mixed with the soil. A single engine drives first and second pumps and a programmable, computerized process control system allocates driving power from the single engine to the first and second pumps to optimize the mixing of the slurry and soil while maximizing the amount of soil being processed.

9 Claims, 9 Drawing Sheets

SINGLE ENGINE SOIL PROCESSING SYSTEM

BACKGROUND AND SUMMARY OF THE INVENTION

The present invention relates in general to an apparatus and method for processing soil in a subterranean earth situs; and more particularly, to an improvement over the method and apparatus disclosed in U.S. Pat. No. 5,396,964 dated Mar. 14, 1995. The present invention, among other things, utilizes a single engine, as opposed to the dual engines of U.S. Pat. No. 5,396,964. The single drive engine is used in combination with first and second hydraulic pumps, one pump being used to pressurize slurry for the processing of subterranean soil and the other pump is used to rotate the processing tool.

It is known in the prior art to process soil in a subterranean situs as shown in U.S. Pat. No. 5,396,964. The text of U.S. Pat. No. 5,396,964 is incorporated by reference as though set forth in full herein. The present invention includes several significant improvements over U.S. Pat. No. 5,396,964 and prior art patents referenced and summarized at columns 1 and 2 of that patent.

In particular, the present invention utilizes a single, relatively high horsepower engine carried on the rear of a crane to provide the necessary power for rotating the soil processing tool and to pressurize the slurry which is introduced into the subterranean situs typically along with the soil processing tool. The present invention also provides a programmable, computer operated system for allocating driving power from the single drive engine to optimize the mixing of slurry and soil while simultaneously maximizing the amount of soil being processed. The present invention also provides a leader column provided with guide means and a top drive allowing for the use of multiple sections of cylindrical collar stock, whereas U.S. Pat. No. 5,396,964 required the use of a square Kelly driven by a rotary table. The square Kelly of U.S. Pat. No. 5,396,964 operates without a leader column or guides and typically experiences instability during start-up and operation.

It is therefore a primary object of the present invention to provide an apparatus and method for processing soil in a subterranean situs utilizing power provided by a single engine and allocating that power to pressurize slurry and to drive the soil processing tool in a manner to optimize the mixing of the slurry and soil and to maximize the amount of soil being processed.

Another object of the invention is to provide an apparatus and method for processing soil in a subterranean situs utilizing cylindrical collar stock together with a leader column and guides, resulting in a drive mechanism with greatly increased stability, ease of operation and dependability, all at a reduced cost.

A further object of the invention is to provide a method and apparatus for processing soil in a subterranean situs utilizing a process control system receiving as input variables such as the soil and slurry characteristics of each subterranean situs to determine the appropriate slurry injection pressure while maximizing the amount of soil being processed.

Another object of the invention is to provide an apparatus and method for processing subterranean soil incorporating a pull-down winch responsive to a programmable and computerized process control system to advance a soil processing tool at a rate determined by the process control system.

Yet another object of the invention is to provide a soil processing system utilizing a crane having a single engine carried at the rear of the crane for driving hydraulic pumps for pressurizing slurry and rotating the processing tool and wherein a spotter is carried at the front of the crane to position the leader column and wherein the slurry pump is carried on the spotter.

Further objects and advantages of the invention will become apparent from the following description of a preferred embodiment and the drawings wherein:

DETAILED DESCRIPTION OF THE DRAWINGS

Figure 1:
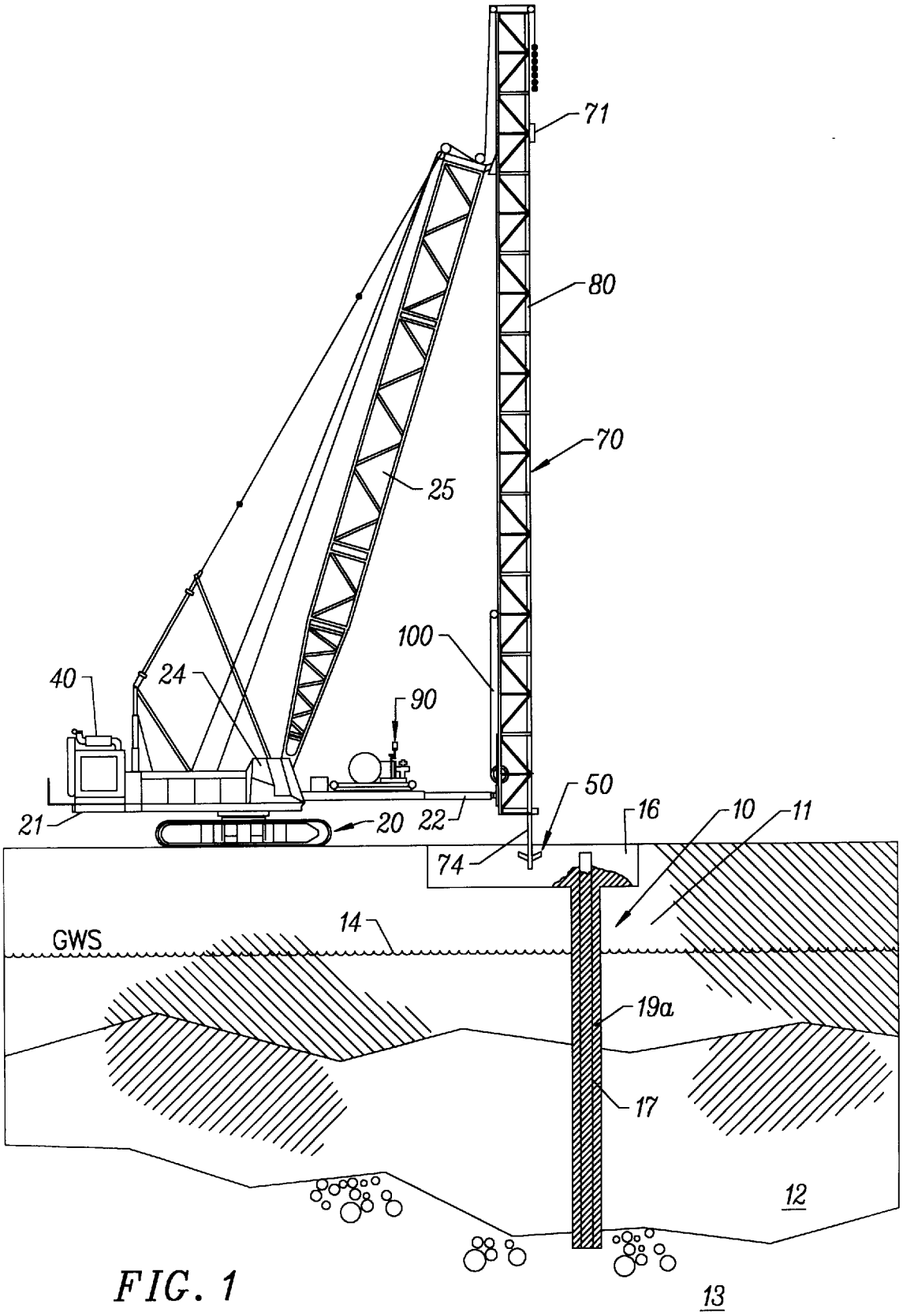
FIG. 1 is a schematic representation of the apparatus of the present invention shown in the first of six sequential steps, wherein a first hole has been processed and the equipment is being positioned over hole #2.

FIG. 1 shows a crane 20 in position to process soil in a subterranean situs referred to generally as 10. A typical subterranean situs 10 is shown having an upper layer 11 which is sandy in nature and a lower layer 12 which is a stiff clay. A layer of bedrock 13 is also shown in schematic fashion. Subterranean ground water level is shown at 14.

A preliminary step in utilizing the present invention is typically to dig a relatively shallow pier excavation 16, which may be filled with concrete after various pier holes have been formed within the excavation to form a footing. Crane 20 has a rear deck 21 upon which is mounted a single engine 40. Engine 40 is preferably a high horsepower diesel engine generating between 700 and 1200 horsepower. A spotter 22 is carried at the front of crane 20 for positioning leader column 70.

Figure 7:
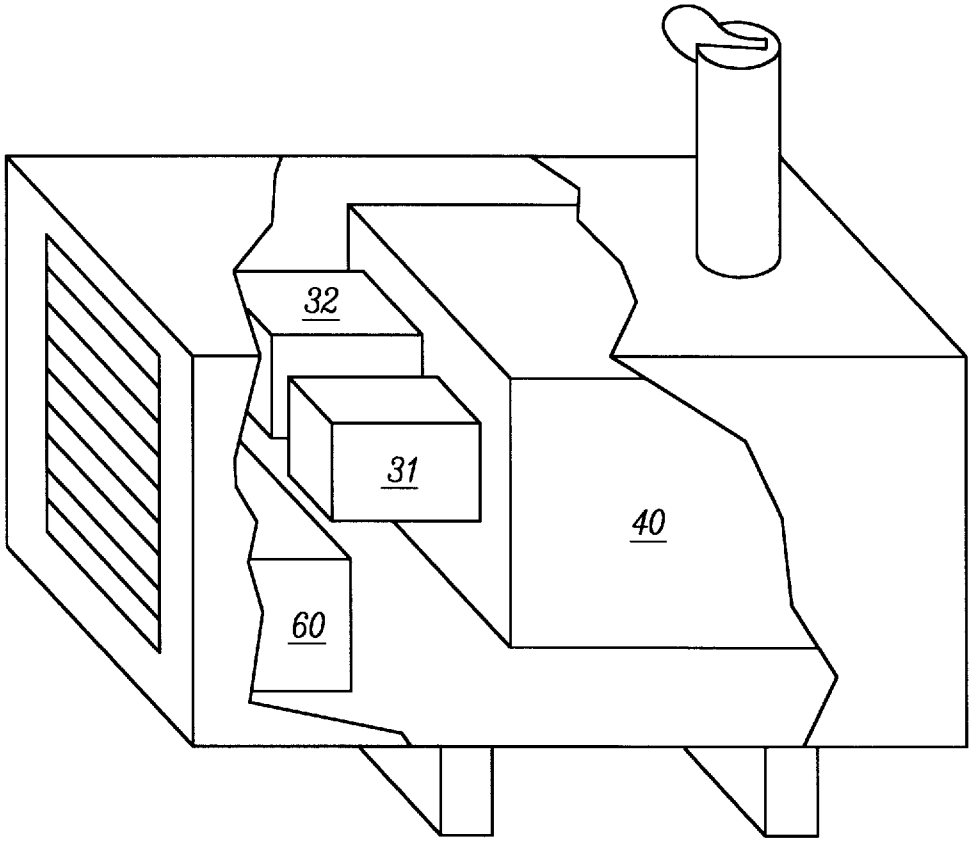
FIG. 7 is a perspective and schematic representation of the single engine, pumps and computerized process control system.

As shown schematically in FIG. 7, single engine 40 is coupled to first and second hydraulic pumps 31 and 32. First pump 31 is utilized to rotate a subterranean processing tool shown generally as 50. Processing tool 50 is hydraulically actuated through hydraulic lines which extend from pump 31 across the body 24 of crane 20, upwardly along boom 25 and across to leader column 70. For clarity, the hydraulic lines are not shown in the drawings.

The second hydraulic pump 32 is also driven directly by single engine 40 and is utilized to pressurize slurry and to introduce the pressurized slurry into the situs 10, typically as each hole is being drilled.

U.S. Pat. No. 4,958,962 is incorporated herein by reference and includes, among other things, a description of slurry velocities and pressures as well as examples of specific rotational speeds and slurry injection velocities.

With respect to FIG. 1, the upper layer may be sandy in some topographies and is relatively easy to drill. For example, a moderate sand can be thoroughly mixed at a slurry injection pressure of approximately 900 psi and a velocity of approximately 180 feet per second (fps). A light sand layer can be processed with slurry injected at approximately 500 psi and at approximately 100 fps. Firmer soil layers, such as stiff clay layer 12, requires the slurry to be injected at approximately 2000 psi (and up to 5,000 psi) and at a velocity of approximately 375 fps.

A means 90 is connected to and responsive to second pump 32 for pressurizing slurry. Means 90 is preferably a commercially available triplex or 3 piston pump driven by a hydraulic motor (not shown). The hydraulic motor is driven by hydraulic pump 32.

As shown in FIG. 7, a computer 60 is provided for allocating driving power from single engine 40 to first and second pumps 31 and 32 to optimize the mixing of the slurry and soil while simultaneously maximizing the amount of soil being processed. U.S. Pat. No. 4,958,962 gives examples and description of injection velocities, pressures and typical rate of advancement of the soil processing tool 50. The computer 60 is programmed to divert sufficient power from single engine 40 to second pump 32 to sufficiently pressurize the slurry to insure adequate mixing of the slurry into the soil and secondarily to maximize the advancement rate of the processing tool 50 through the soil. U.S. Pat. No. 4,958,962 is again referred to as an example of how optimum slurry pressures relate to speed of advancement of the processing tool. However, U.S. Pat. No. 4,958,962 and other prior art patents related to this subject matter invariably utilize separate sources of power for pressurizing the slurry and for advancing the processing tool. Experience has shown that the use of a single power source is advantageous for pressurizing the slurry and advancing the processing tool in order to simplify the programming of computer 60 and to simply the mounting and interconnection of the engine, computer and pumps 31 and 32.

Leader column 70 supports a top drive 71 as well as sections of cylindrical collar stock 74. Soil processing tool 50 is carried by cylindrical collar stock 74. Leader column 70 includes guide means 78 for guiding collar stock 74. Guide means 78 include an upper guide means 78*a*, a mid-column guide 78*b* and a lower column guide 78*c*. The use of multiple guides 78*a*, 78*b* and 78*c* provides greatly increased stability of collar stock 74, particularly when compared with the square Kelly stock shown in U.S. Pat. No. 5,396,964. The square Kelly stock is essentially unguided and can become quite unstable during start-up and operation.

The apparatus also includes a pulldown winch 100 carried by leader column 70 to advance the soil processing tool 50 downwardly at a rate determined by the computerized process control system 60.

Figure 2:
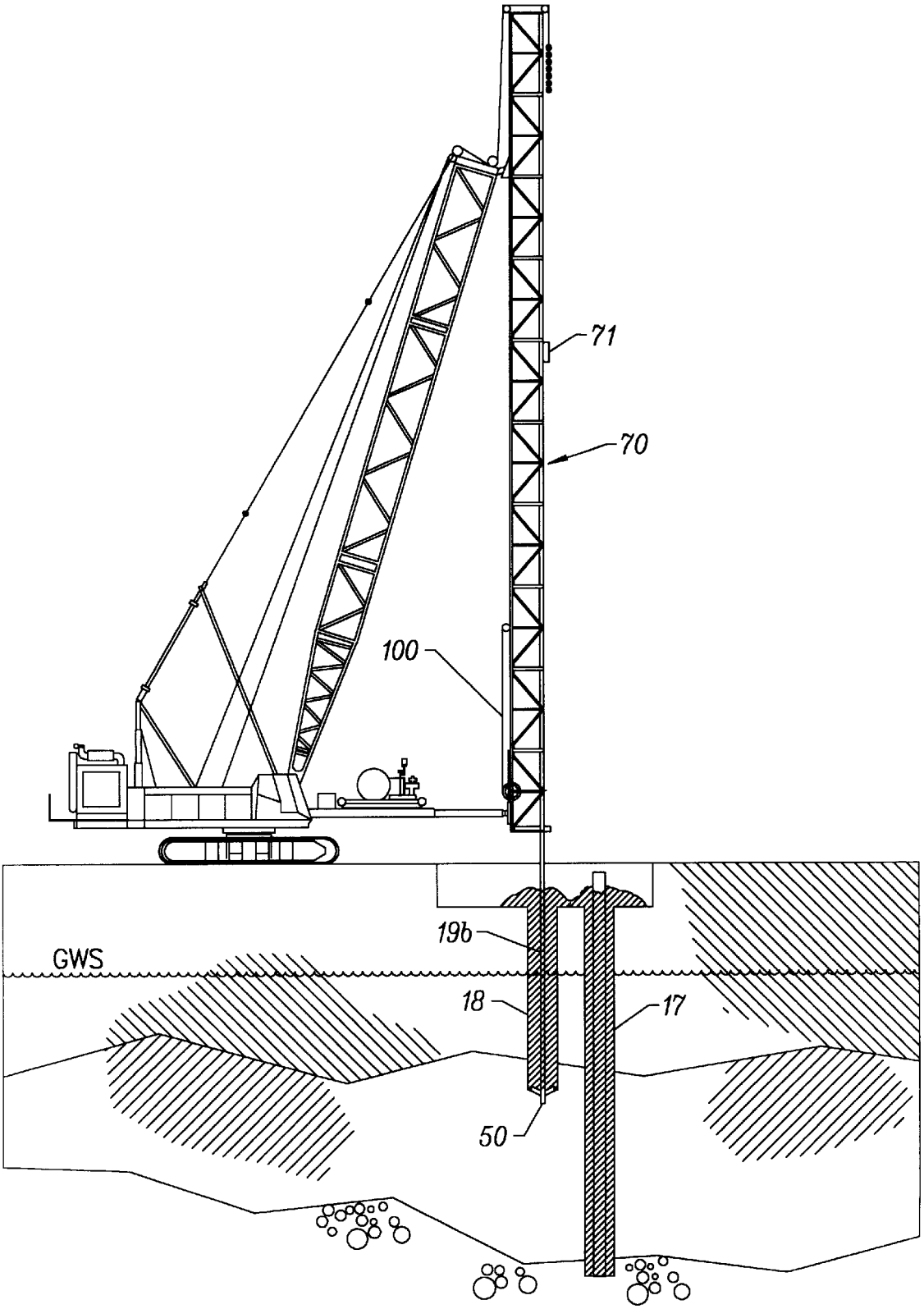
FIG. 2 is a schematic representation of the apparatus shown in FIG. 1, wherein the second hole is approximately half way completed and showing the soil being processed as hole #2 is being processed.

Referring to FIG. 2, a second hole 18 is being drilled close to first hole 17. The soil processing tool 50 is being rotated by first hydraulic pump 31 and is simultaneously injecting pressurized slurry into the soil as the tool is rotated. Pulldown winch 100 is connected to top drive 71 and has pulled top drive 71 to a position approximately halfway down leader column 70. The combined pressurized slurry and soil 19*b* is filling the second hole 18 as tool 50 is advanced downwardly.

Figure 3:
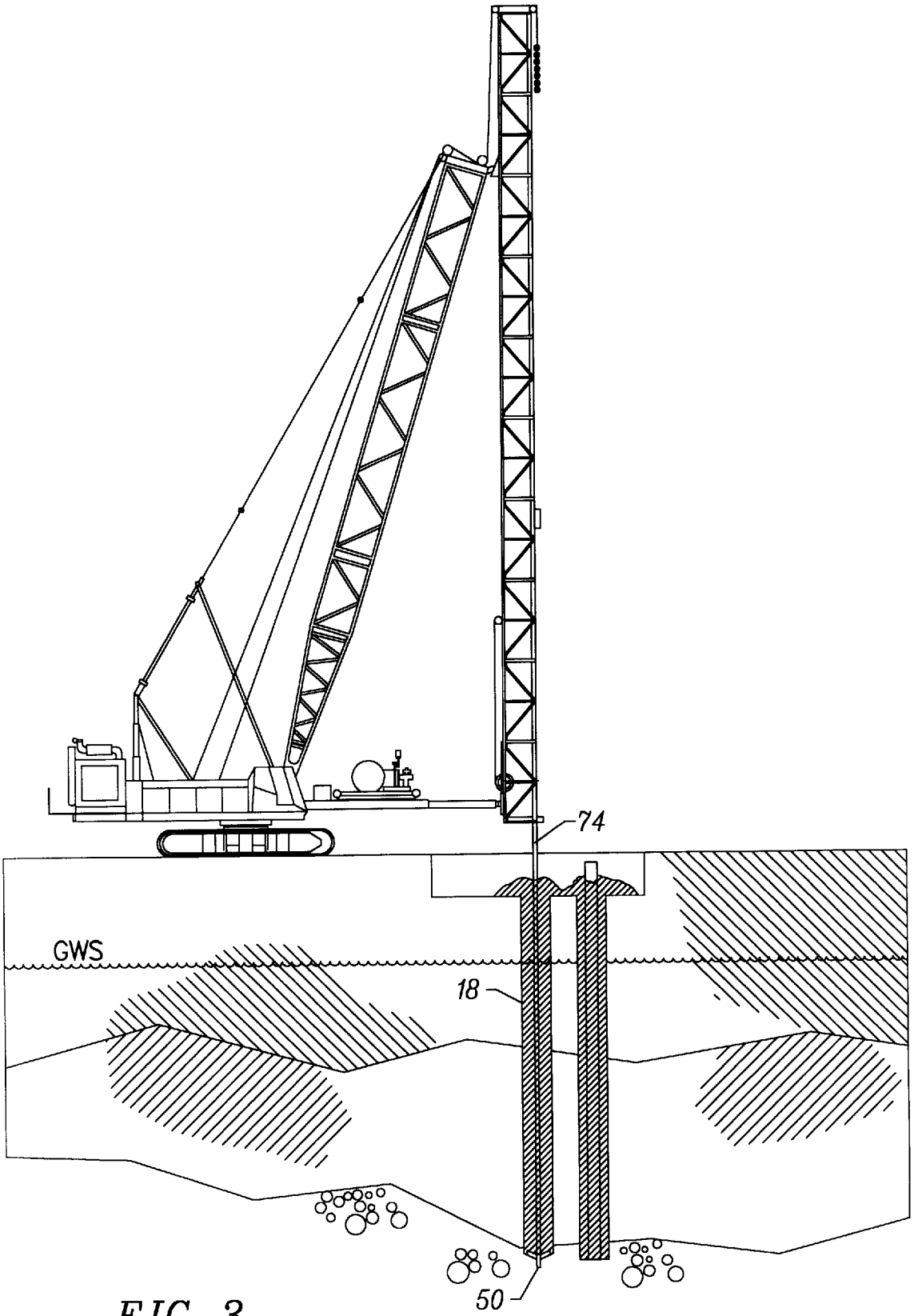
FIG. 3 is a schematic representation of the apparatus shown in FIGS. 1 and 2, wherein hole #2 has been drilled to depth and the soil therein simultaneously processed and wherein the soil processing tool is ready to be withdrawn.

FIG. 3 shows the soil processing tool 50 advanced to the bottom of second hole 18 and about to be withdrawn.

Figure 4:
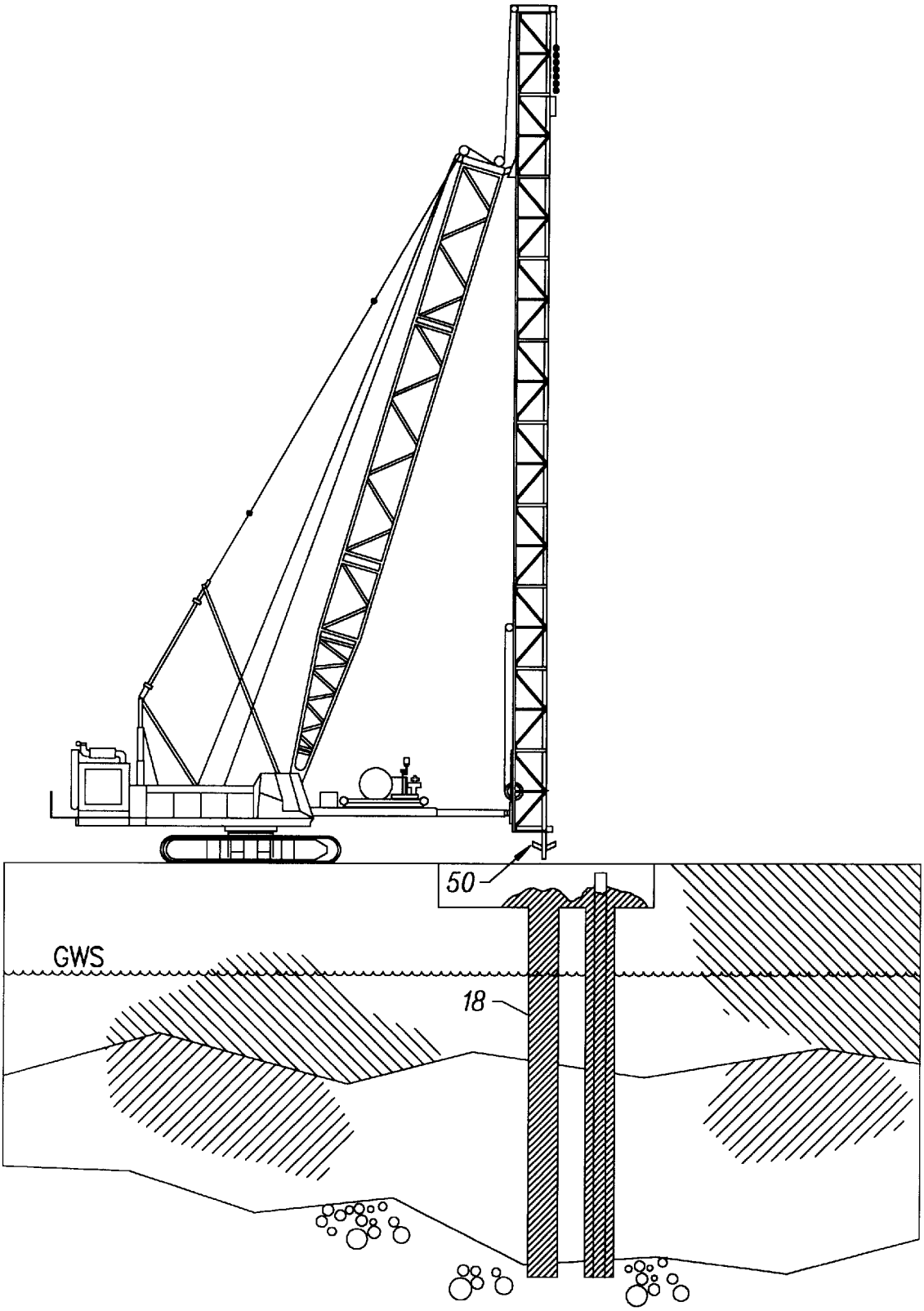
FIG. 4 is a schematic representation of the apparatus of FIGS. 1–3, wherein the soil processing tool is shown having been removed from hole #2.

FIG. 4 shows the soil processing tool 50 fully withdrawn from the second hole 18.

Figure 5:
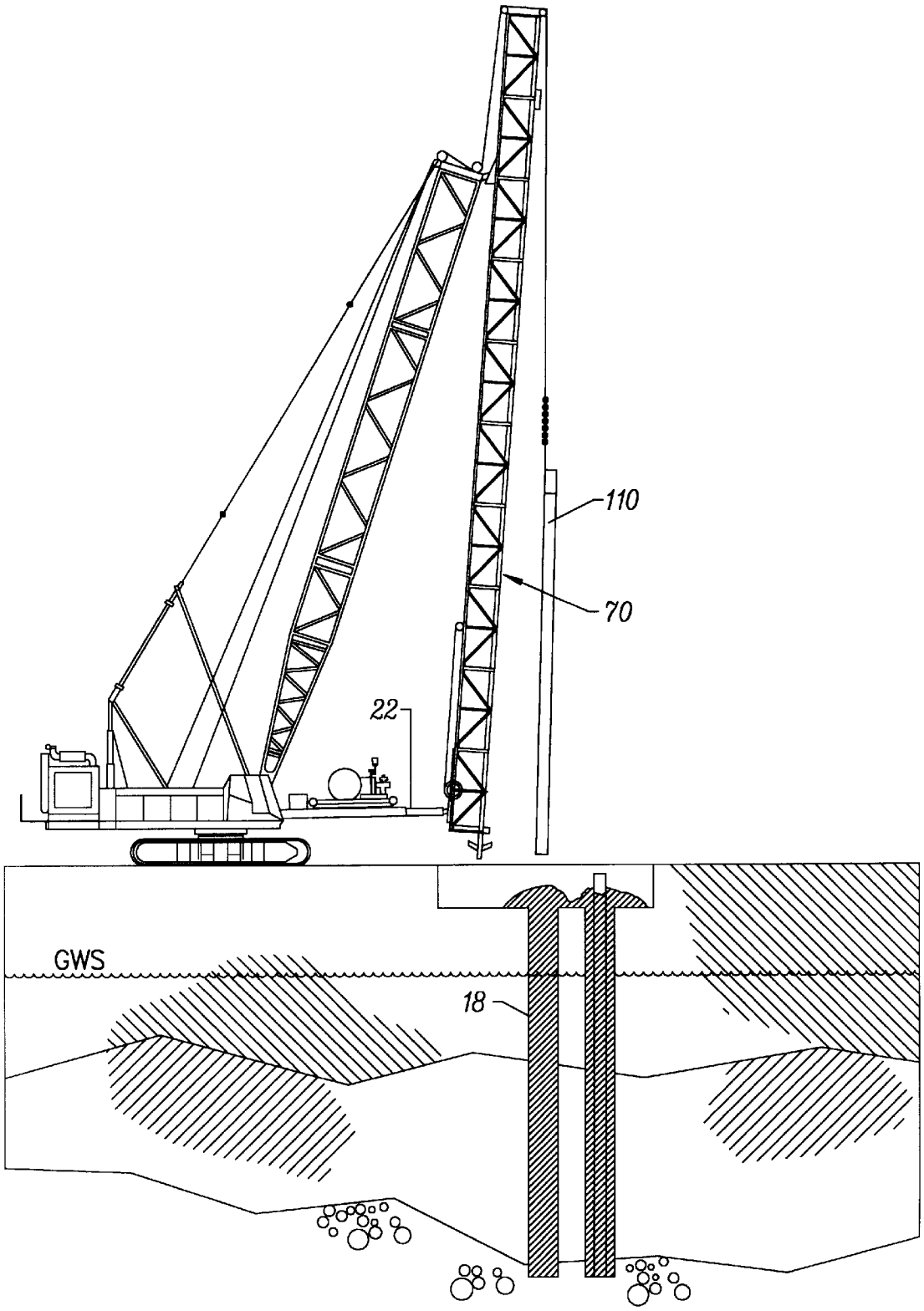
FIG. 5 is a schematic representation of the apparatus of FIGS. 1–4 showing the processing apparatus pulled clear from the hole and showing an optional structural member being positioned over hole #2.

FIG. 5 shows the leader column 70 pulled back by spotter 22 and structural member 110 suspended vertically and ready to be dropped into second hole 18. The structural member 110 is typically a steel insert and is optional.

Figure 6:
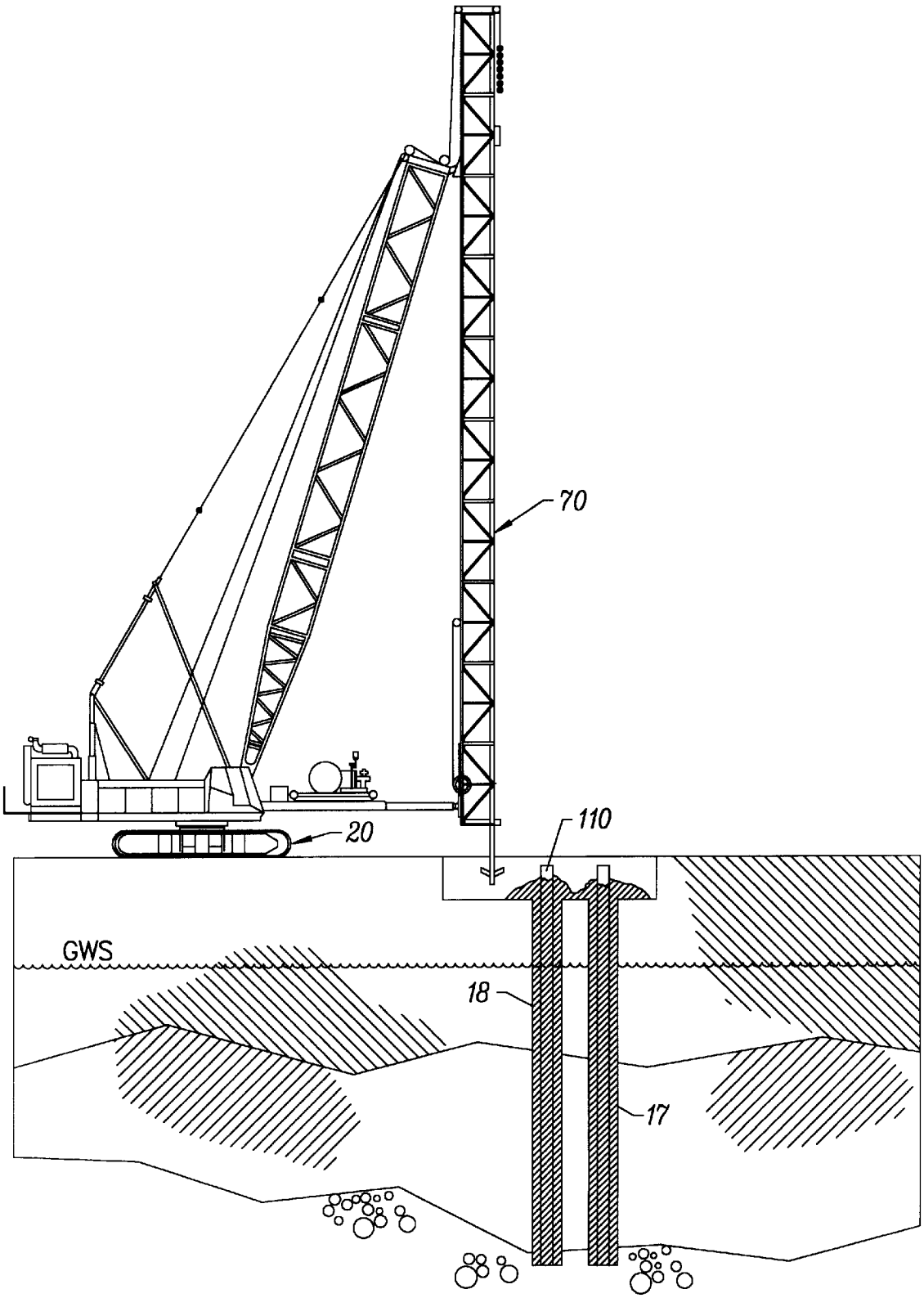
FIG. 6 is a schematic representation of the apparatus shown in FIGS. 1–5 wherein the structural element has been lowered to the bottom of hole #2 and the apparatus is repositioned to start the next hole.

FIG. 6 shows the steel structural insert 110 fully inserted into second hole 18 and the crane 20 and leader column 70 have been repositioned to start drilling another hole.

Figure 8:
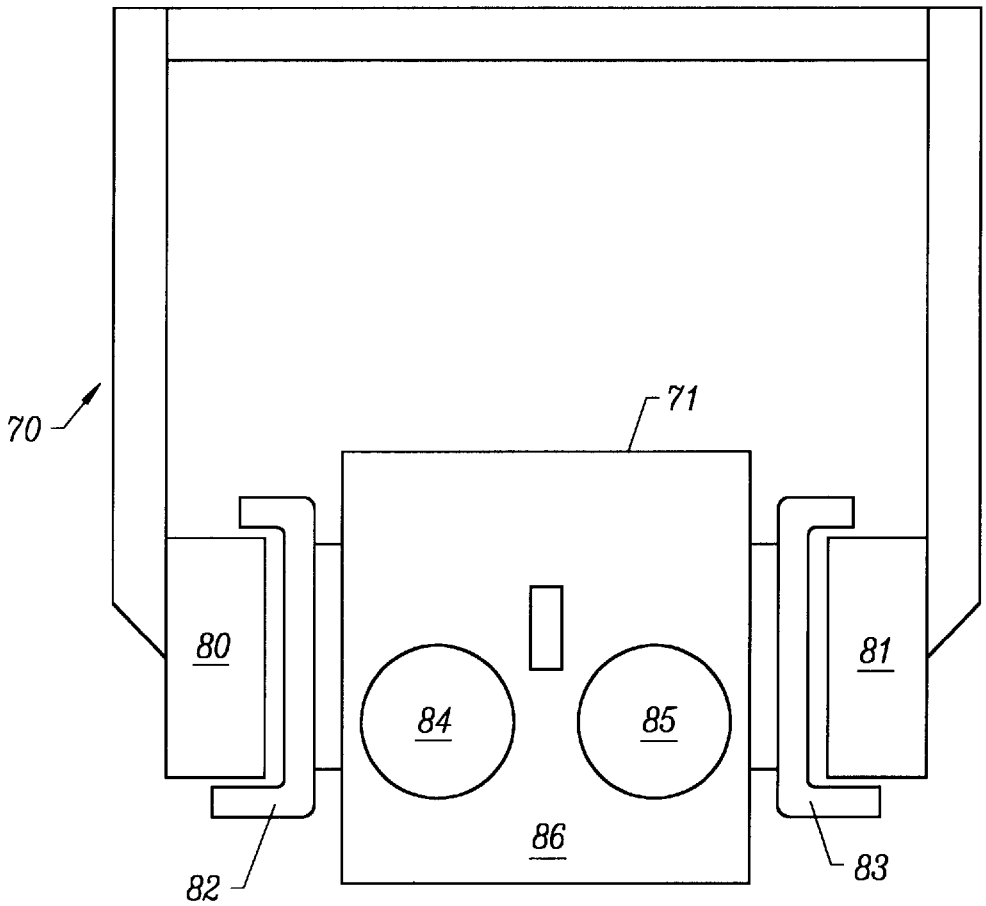
FIG. 8 is a plan view of the leader column and top drive.
Figure 9:
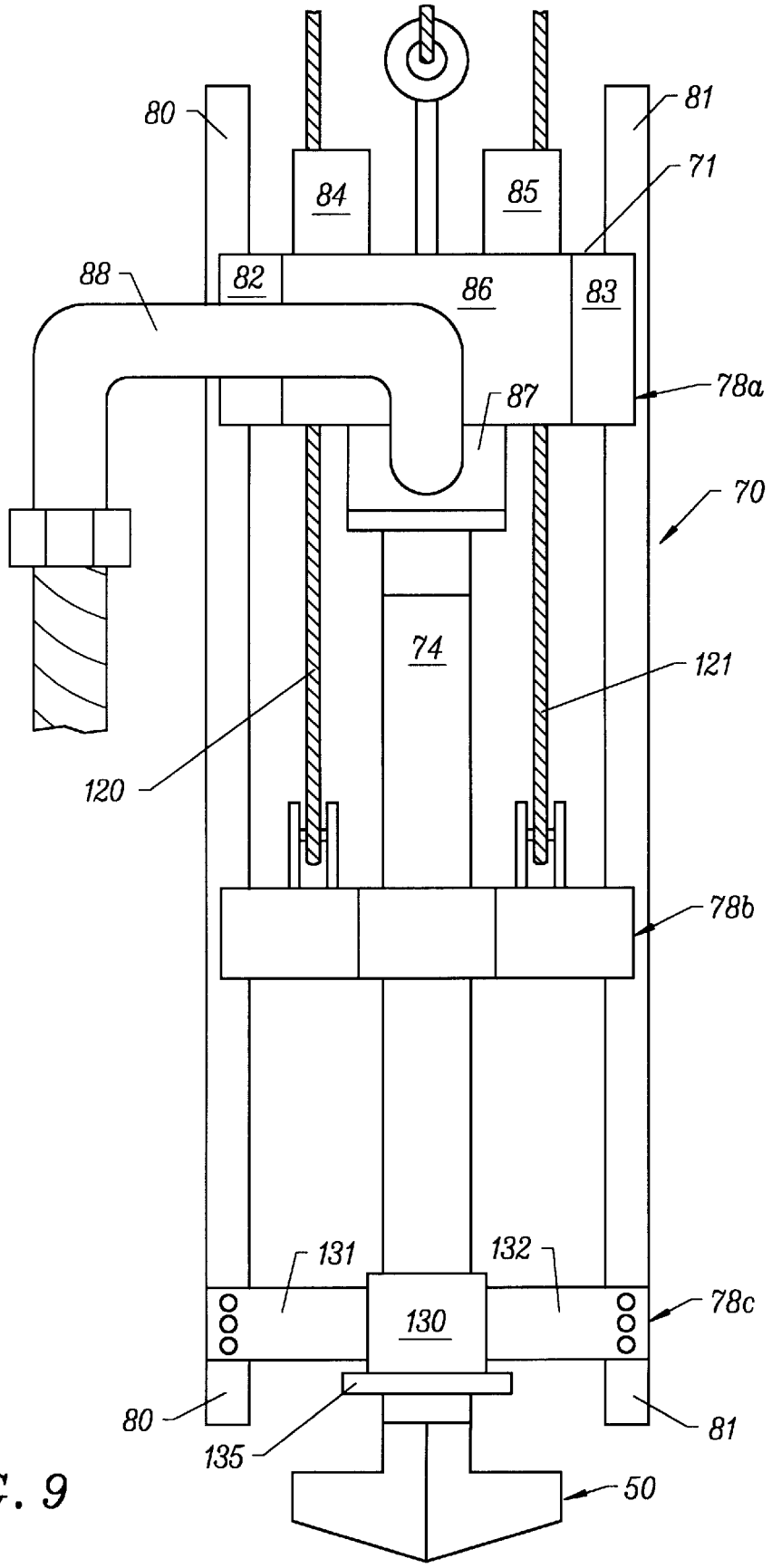
FIG. 9 is a front elevational and schematic view of the leader column, collar stock and soil processing tool.

FIG. 8 and 9 show in greater detail the top drive 71 and leader column 70. Leader column 70 has fixed guide rails 80 and 81 which support sliding U-shaped channels 82 and 83, respectively. Top drive 71 includes a pair of hydraulic drive motors 84 and 85 and a drive transmission contained in housing 86. As shown in FIG. 9, channels 82 and 83 together form an upper guide means 78*a* which tends to stabilize collar stock 74. A slurry swivel 87 is carried at the top of collar stock 74 and conducts pressurized slurry pumped through slurry supply line 88 downwardly through collar stock 74 to soil processing tool 50. Center guide means 78*b* includes suspension cables 120 and 121 which keep center guide 78*b* approximately halfway between top drive 71 and lower guide 78*c* as collar stock 74 is advanced downwardly relative to leader column 70. Lower guide 78*c* includes a bearing collar 130 which may preferably include a rubber wiper connected by arms 131 and 132 to leader column rails 80 and 81. A rubber wiper 135 is mounted below lower guide 78*c* and serves to wipe slurry off of collar stock 74 as it is withdrawn from the hole.

It is to be understood that variations in the specific designs shown in the drawings may be made without departing from the spirit of the invention.

What is claimed is:

1. In an apparatus for processing soil in a subterranean situs wherein a pressurized slurry is introduced and mixed with said soil, the improvement comprising:

a single engine, first and second pumps driven by said single engine, a subterranean soil processing tool connected to and rotated by said first pump, means connected to and responsive to said second pump for pressurizing said slurry and introducing said pressurized slurry into said situs, and means for allocating driving power from said single engine to said first and second pumps to optimize the mixing of said slurry and soil while simultaneously maximizing the amount of soil being processed.

2. The apparatus of claim 1 further comprising:

a leader column, a top drive, top driven sections of cylindrical collar stock, and wherein said soil processing tool is carried by said cylindrical collar stock.

3. The apparatus of claim 2 further comprising guide means carried by said leader column for guiding said collar stock.

4. The apparatus of claim 1 wherein said means for allocating driving power comprises a programmable, computerized process control system which receives as input variables the soil and slurry characteristics of each subterranean situs while maximizing the amount of soil being processed.

5. The apparatus of claim 4 further comprising a pull down winch carried by said leader column, is connected to said top drive, and is responsive to said process control system to advance said soil processing tool at a rate determined by said process control system.

6. The apparatus of claim 2 wherein said first and second pumps are hydraulic pumps and wherein said means for pressurizing said slurry is a hydraulically driven slurry pump, and further comprising:

a crane, said single engine carried at the rear of said crane, said first and second hydraulic pumps coupled to said single engine, a spotter carried at the front of said crane for positioning said leader column, and wherein said slurry pump is carried by said spotter.

7. A method for processing soil in a subterranean situs wherein a pressurized slurry is introduced into said situs through a rotating and advancing soil processing tool and mixed with said soil, comprising the steps:

providing a single source of power to pressurize said slurry and to rotate said soil processing tool, allocating a sufficient portion of power from said single source of power to pressurize said slurry to obtain through mixing of said slurry with said soil, and simultaneously allocating a sufficient portion of power from said single source of power to maximize the amount of soil being processed.

8. The method of claim 7 wherein said allocation of power is achieved by using a programmable, computerized process control system.

9. The method of claim 8 wherein said allocation of power is achieved in real time in response to variable soil and slurry characteristics as said tool is being advanced and rotated.

* * * * *